US011154098B2

(12) United States Patent
Moczygemba

(10) Patent No.: US 11,154,098 B2
(45) Date of Patent: Oct. 26, 2021

(54) SYSTEMS AND METHODS ASSOCIATED WITH COLLAR STAYS

(71) Applicant: Charles Moczygemba, Austin, TX (US)

(72) Inventor: Charles Moczygemba, Austin, TX (US)

( * ) Notice: Subject to any disclaimer, the term of this patent is extended or adjusted under 35 U.S.C. 154(b) by 135 days.

(21) Appl. No.: 16/513,488

(22) Filed: Jul. 16, 2019

(65) Prior Publication Data

US 2020/0037672 A1 Feb. 6, 2020

Related U.S. Application Data

(60) Provisional application No. 62/714,754, filed on Aug. 5, 2018.

(51) Int. Cl.
*A41B 3/06* (2006.01)
*A41B 3/08* (2006.01)

(52) U.S. Cl.
CPC ..... *A41B 3/06* (2013.01)

(58) Field of Classification Search
CPC ..... A41B 3/06; A41B 3/08; A41B 1/14
See application file for complete search history.

(56) References Cited

U.S. PATENT DOCUMENTS 579,788 A * 3/1897 Brodeur ..... A41B 3/06 2/132
811,326 A * 1/1906 Reynolds ..... A41B 3/06 2/134
858,319 A * 6/1907 Adams ..... A41C 1/00 450/145
902,576 A * 11/1908 Gustafson ..... A41D 27/18 2/98
1,658,219 A * 2/1928 Anderson ..... A41B 3/08 2/132
1,751,655 A * 3/1930 Oppermann ..... A41B 3/06 2/132
1,820,287 A * 8/1931 Morck ..... A41B 3/06 2/132
1,875,886 A * 9/1932 Ramont ..... A41B 3/12 2/132
1,908,525 A * 5/1933 Manaster ..... A41B 3/06 2/132
1,923,577 A * 8/1933 Manaster ..... A41B 3/06 2/132
2,004,288 A * 6/1935 Krick ..... A41B 3/06 2/132
2,014,952 A * 9/1935 Robbins ..... A41B 3/06 2/132
2,066,636 A * 1/1937 Manaster ..... A41B 3/06 2/132
2,123,274 A * 7/1938 Dailey ..... A41B 3/12 24/361
2,371,338 A * 3/1945 Manaster ..... A41B 3/12 2/132
2,372,752 A * 4/1945 Vaccarella ..... A41B 3/06 2/132
2,423,776 A * 7/1947 Humpola ..... A41D 25/027 2/132

(Continued)

*Primary Examiner* — Robert H Muromoto, Jr.
(74) *Attorney, Agent, or Firm* — Pierson IP, PLLC

(57) ABSTRACT

Dynamic collar stays that are configured to change lengths on multiple axis, and have multiple hinges.

18 Claims, 7 Drawing Sheets

(56) References Cited

U.S. PATENT DOCUMENTS 2,425,872 A * 8/1947 Forsland ..... A41B 3/12 2/132
2,438,325 A * 3/1948 Pophal ..... A41D 25/12 2/132
2,439,088 A * 4/1948 Herr ..... A41B 3/06 2/132
2,487,583 A * 11/1949 Patch ..... A41B 3/06 2/132
2,494,185 A * 1/1950 Magney ..... A41B 3/06 2/132
2,564,008 A * 8/1951 Holt ..... A41B 3/06 2/132
2,639,436 A * 5/1953 Gavrilovich ..... A41B 3/06 2/132
2,659,892 A * 11/1953 Sharp ..... A41B 3/06 2/132
2,799,024 A * 7/1957 Oscard ..... A41B 3/06 2/132
2,899,681 A * 8/1959 Oscard ..... A41B 3/06 2/132
3,075,202 A * 1/1963 Rubio ..... A41B 3/06 2/132
3,129,435 A * 4/1964 Spence ..... A41C 1/20 2/257
4,118,803 A * 10/1978 Blau ..... A41B 3/08 2/132
4,286,337 A * 9/1981 Malouf, Jr. ..... A41B 3/06 2/116
6,202,221 B1 * 3/2001 Ackley, Jr. ..... A41C 1/14 2/255
6,748,602 B1 * 6/2004 Barnes ..... A41B 3/06 2/132
7,409,730 B2 * 8/2008 Boos ..... A41F 1/002 2/132
8,220,075 B2 * 7/2012 Chen ..... B25F 1/00 2/132
8,296,865 B2 * 10/2012 Garcia ..... A41B 3/06 2/132
8,950,014 B2 * 2/2015 Schottenstein ..... A41B 3/06 2/132
10,028,538 B2 * 7/2018 Spitzfaden ..... A41B 3/06
10,039,328 B2 * 8/2018 English ..... A41B 3/06
2002/0113099 A1 * 8/2002 Kim ..... B65D 85/182 223/81
2010/0313331 A1 * 12/2010 English ..... A41B 3/06 2/132
2011/0113526 A1 * 5/2011 Harris ..... A41B 3/06 2/132
2011/0219515 A1 * 9/2011 Chen ..... A41B 3/06 2/132
2012/0023640 A1 * 2/2012 Gutierrez Garcia ..... A41B 3/06 2/116
2012/0227163 A1 * 9/2012 Schottenstein ..... A41B 3/06 2/255
2014/0223640 A1 * 8/2014 English ..... A41B 3/06 2/256
2015/0020290 A1 * 1/2015 Yarbrough ..... A41B 3/06 2/129

* cited by examiner

SYSTEMS AND METHODS ASSOCIATED WITH COLLAR STAYS

CROSS-REFERENCE TO RELATED APPLICATIONS

This application claims a benefit of priority under 35 U.S.C. § 119 to Provisional Application No. 62/714,754 filed on Aug. 5, 2018, which is fully incorporated herein by reference in its entirety.

BACKGROUND INFORMATION

Field of the Disclosure

Examples of the present disclosure are related to systems and methods associated with collar stays. More particularly, embodiments disclose dynamic collar stays that are configured to change lengths in multiple axis, and have multiple hinges, joint, pivots, swivels, etc. (referred to hereinafter collectively and individually as "hinges") that are configured to control rotating about an axis.

Background

Collar stays are a common garment accessory consisting of smooth strips of rigid materials that are inserted into specially made pockets within an underside of a shirt's collar to stabilize the collar's points. Conventional collar stays are manufactured in multiple lengths to fit different collar designs, or are designed with means to adjust the length of the collar stay along a single axis, which only prevents curling and does not address other unwanted collar postures.

Accordingly, needs exist for more effective and efficient systems and methods for a collar stay device that expands and retracts along multiple independent axis, wherein a first collar stay is positioned on a first end of a band and a second collar stay is positioned on a second end of the band.

SUMMARY

Embodiments described herein are associated with system and methods for a collar stay device that is configured to adjust based on a user's neck size, collar pockets angles, and collar pocket sizes. Embodiments may be designed for robustness and simplicity, wherein the collar stay device may be worn repeatedly with minimal maintenance.

Embodiments may include a first band, second band, first coupling mechanism, second coupling mechanism, first collar stay, and second collar stay.

The first band and the second band may be shafts that are configured to be wrapped around a collar of an article of clothing, such as shirt. The first band and the second band may assist in maintaining the collar in a rigid position. The first band and the second band may be coupled together via the first coupling mechanism at a changing first location, and the second coupling mechanism at a changing second location. The first band and the second band may be configured to slide relative to each other along a first linear axis to dynamically change a distance from a proximal end of the first band to a distal end of the second band. This may allow for the changing the length of the collar stay device. In embodiments, portions of the first band and the second band may be configured to be overlaid on each other.

The first collar stay may be configured to be inserted into a first stay pocket on the article of clothing. The first collar stay may be positioned proximate to the proximal end of the first band. The second collar stay may be configured to be inserted into a second stay pocket of the article of clothing. The second collar stay may be configured to be positioned proximate to the distal end of the second band. The first collar stay and the second collar stay may be configured to be elongated, shortened, and rotated independently from one another. The collar stays may include a first portion, second portion, and a third portion. The first portion of the collar stays may be coupled to the band via a first hinge, that allows the collar stays to rotate with respect to the linear axis of the band. The first portion of the collar stays may be coupled to the second and third portions via a second hinge. The second portion and the third portion of the collar stays may be configured to be rotated independently to dynamically change a length of the collar stay. This may allow the collar stays to be elongated or shortened on a second linear axis that intersects with the first linear axis of the bands.

Accordingly, embodiments are configured to create an adjustable collar stay device that is configured to give structure to an article of clothing, which can be adjusted to various neck sizes, stay pocket lengths, stay pocket angles, and desired widths of collar openings.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
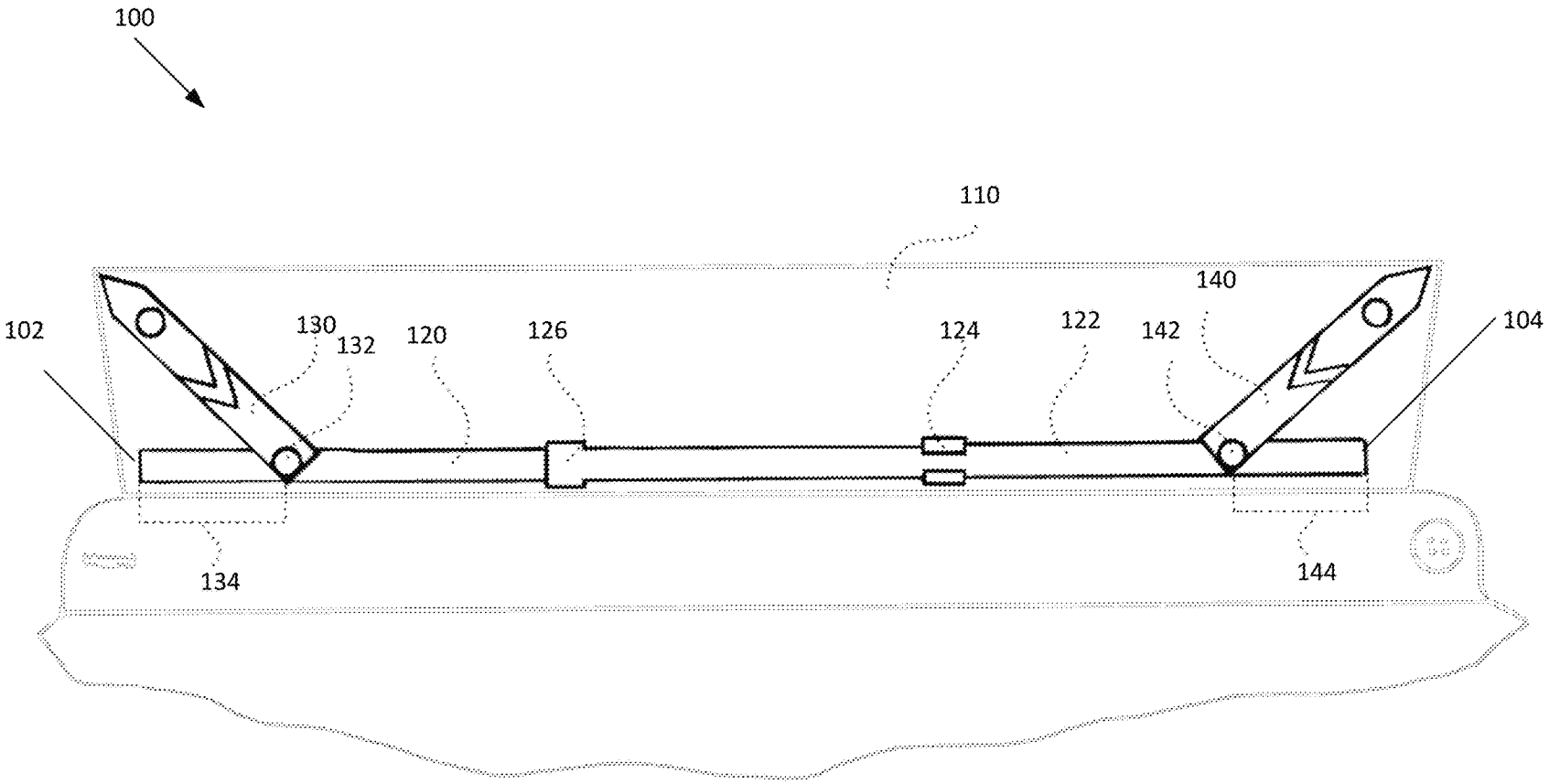
FIG. 1 depicts a collar stay device, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

Embodiments described herein are associated with system and methods for a collar stay device that is configured to adjust based on a user's neck size, collar pockets angles, and collar pocket sizes.

FIG. 1 depicts a collar stay device 100, according to an embodiment. Collar stay device 100 may be configured to give structure to an article of clothing 110, such as a collared shirt, that can be adjusted to various sizing and shapes. Collar stay device 100 may include a first band 120, second band 122, first coupling device 124, second coupling device 126, first collar stay 130, and second collar stay 140.

First band 120 and second band 122 may be configured to be coupled together via first coupling device 124 and second coupling device 126. First band 120 and second band 122 may be configured to slide along a first linear axis to increase or decrease a distance from proximal end 102 of collar stay device 100 to distal end 104 of collar stay device 100. In embodiments, first band 120 and second band 122 may be configured dynamically change the length between proximal end 102 and distal end 104 without changing a length or angle of the collar stays 130, 140. In embodiments, first coupling device 124 may be positioned on a first end of first band 120, and second coupling device 126 may be positioned on a first end of second band 122. First coupling device 124 and second coupling device 126 may be configured to have a larger diameter than that of first band 120 and second band 122, to wrap around and encompass the outer edges of first band 120 and second band 122. This may enable controlled motion of the first band 120 and second band 122 along the first axis. In other embodiments, other devices and coupling mechanisms may be used to increase or decrease the distance from proximal end 102 to distal end 104 of collar stay device 100.

First collar stay 130 may be configured to be positioned proximate to proximate end 102, and may be configured to move, rotate, elongate, and shorten independently from second collar stay 140 and bands 120, 122. First collar stay 130 may be positioned a first distance 134 from proximate end 102. This may enable the rotation of first collar stay 130 while allowing proximal end 102 to provide rigidity and structure to the article of clothing 110. First collar stay 130 may be coupled to first band 120 via a hinge 132, rivet, fulcrum, etc. Hinge 132 may allow first collar stay to rotate 130 around a second axis.

Second collar stay 140 may be configured to be positioned proximate to distal end 104, and may be configured to move, rotate, elongate, and shorten independently from first collar stay 130 and bands 120, 122. Second collar stay 140 may be positioned a first distance 144 from distal end 102. This may enable the rotation of second collar stay 140 while allowing distal end 104 to provide rigidity and structure to the article of clothing 110. Second collar stay 140 may be coupled to second band 122 via a hinge 142, rivet, fulcrum, etc. Hinge 142 may allow second collar stay 140 to rotate around a third axis. In embodiments, the second and third axis may be positioned along the first axis associated with bands 120, 122.

Figure 2:
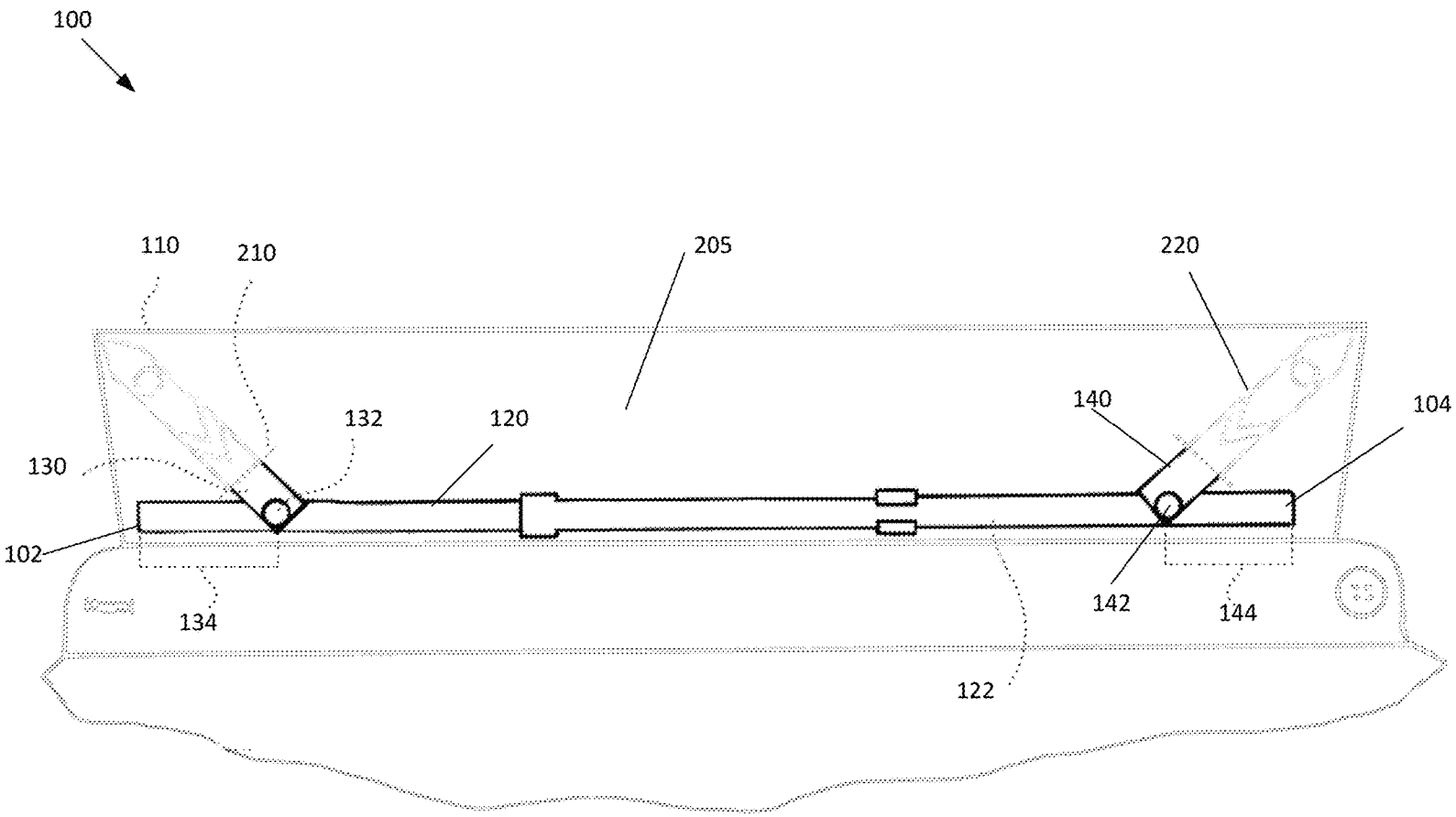
FIG. 2 depicts a collar stay device embedded within an article of clothing, according to an embodiment.

FIG. 2 depicts collar stay device 100 embedded within an article of clothing 110, according to an embodiment.

As depicted in FIG. 2, first band 120 and second band 122 may be elongated such that proximal end 102 and distal end 104 are positioned adjacent to the edges of collar 205. This may allow collar stay device 100 to retain its shape and length while aligning first collar stay 130 with a first stay pocket 210 and second collar stay 140 with a second stay pocket 220. In embodiments, responsive to aligning the hinges with the corresponding pockets, first collar stay 130 may be rotated via hinge 132 such the angle of first collar stay 130 matches that of first stay pocket 210. Further, second collar stay 140 may be rotated via hinge 142 such that the angle of second collar stay 140 matches that of second stay pocket 220.

Figure 3:
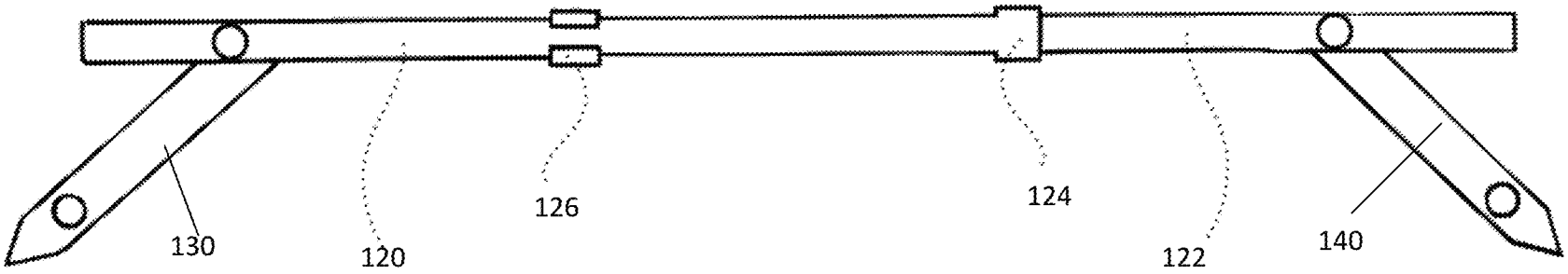
FIG. 3 depicts a rear view of a collar stay device, according to an embodiment.

FIG. 3 depicts a rear view of collar stay device 100, according to an embodiment.

As depicted in FIG. 3, first coupling device 124 and second coupling device 126 may have a similar shape, while facing opposite directions.

Figure 4:
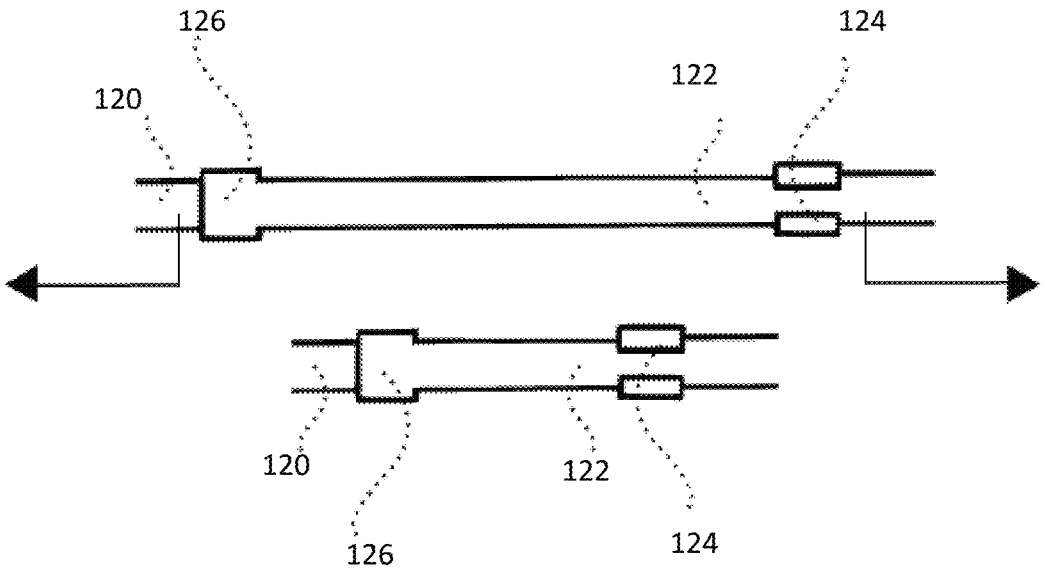
FIG. 4 depicts a first band and a second band, according to an embodiment.

FIG. 4 depicts first band 120 and second band 122, according to an embodiment. As depicted, first band 120 and second band 122 may be configured to slide away from each other, increasing the distance between first coupling device 124 and second coupling device 126, to elongate a length of the collar stay device 100. First band 120 and second band 122 may be configured to slide towards each other, decreasing the distance between first coupling device 124 and second coupling device 126, to shorten the length of the collar stay device 100.

Figure 5:
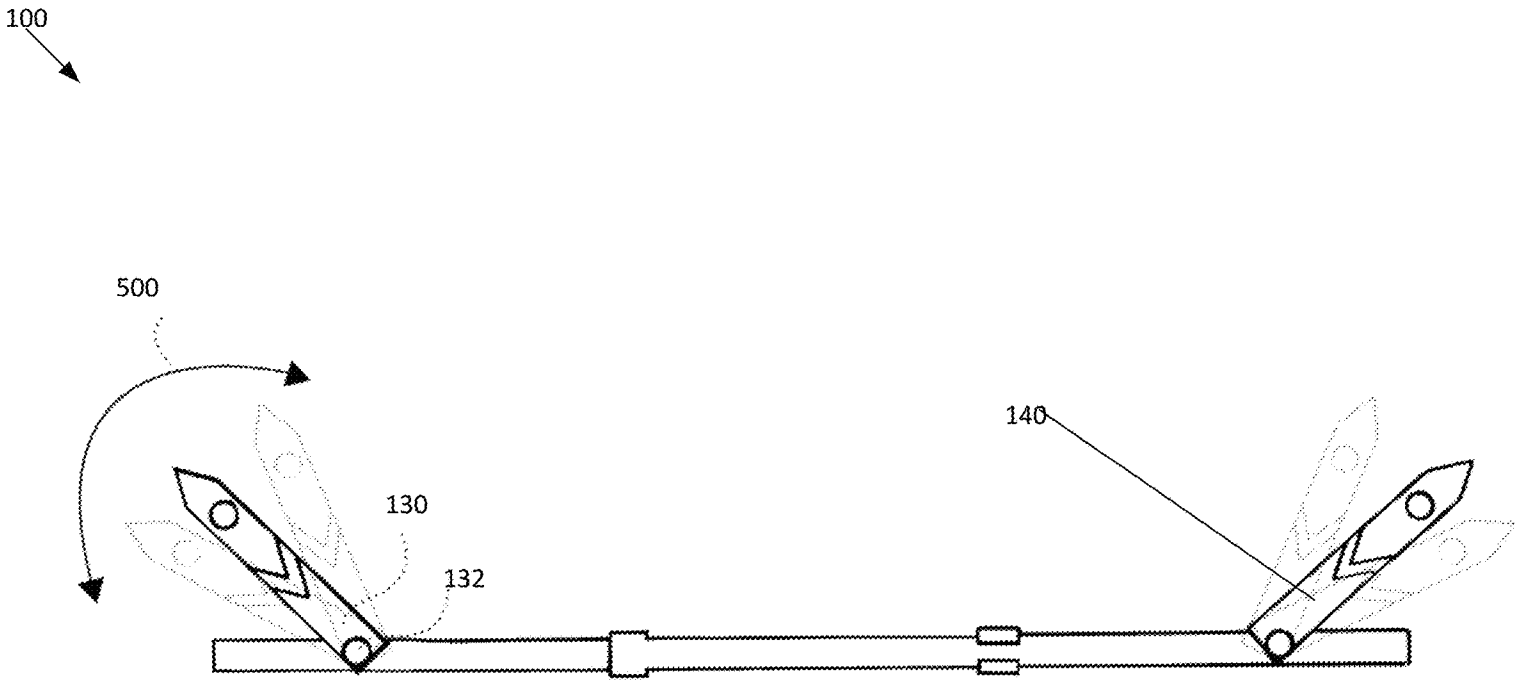
FIG. 5 depicts the rotation of a first collar stay, according to an embodiment.

FIG. 5 depicts the rotating 500 of first collar stay 130, according to an embodiment. As depicted in FIG. 5, first collar stay 130 may be configured to rotate about hinge 132, wherein first collar stay 130 may rotate 500 in an axis around hinge 132 independently from the movement of the bands and the second collar stay 140. Furthermore, second collar stay 140 may be configured to similarly rotate about another axis.

Figures 6, 7, 8:
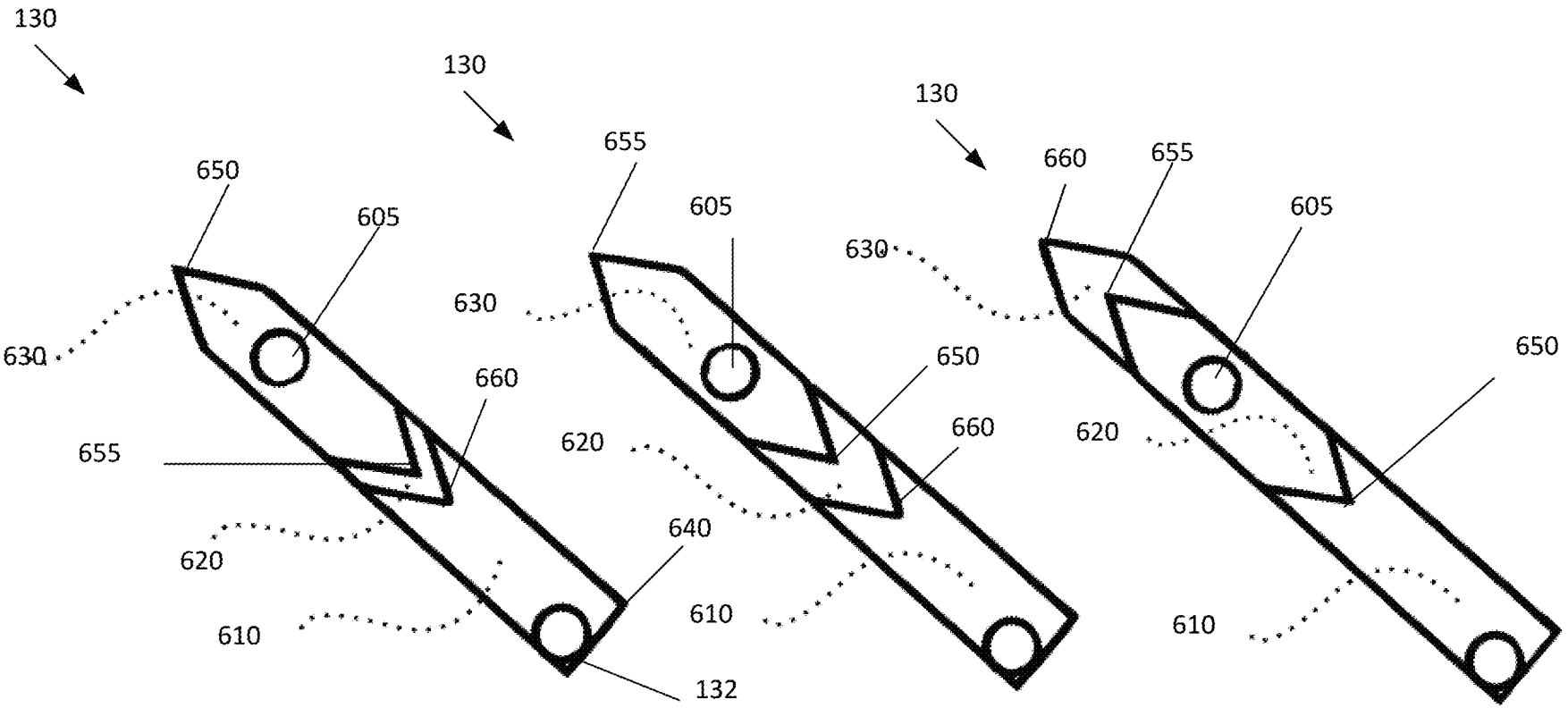
FIGS. 6-8 depict different modes of operation of a first collar stay, according to an embodiment.

FIGS. 6-8 depict a first collar stay 130, according to an embodiment. As depicted in FIGS. 6-8, first collar stay 130 may include a first portion 610, second portion 620, and third portion 630, which may be configured to be overlaid on each other.

First portion 610 may be configured to be a base of first collar stay 130, and be directly coupled to first band 120 via hinge 132. Second portion 620 and third portion 630 may be configured to be coupled to first portion 610 via second hinge 605, wherein second portion 620 is overlaid on first portion 610, and third portion 630 is overlaid on second portion 620. In embodiments, both ends of second portion 620 and third portion 630 may be triangular in shape.

Second hinge 605 may be positioned a first distance between a first end 640 and a second end of first portion 610, and be configured to allow second portion 620 and third portion 630 to rotate independently of each other to change a length of first collar stay 130 along a linear axis that intersects with the linear axis of the bands.

Second portion 620 may be coupled to first portion 610 and third portion 630 via second hinge 605, wherein second hinge 605 is not positioned equidistance from a first end 660 of second portion 620 to a second end (not shown) of second portion 620. In embodiments, if first end 660 is positioned proximate to first end 640 of first portion 610, then an end 650, 655 of third portion 650 may form a distal tip of first collar stay 130. However, if the second end of second portion 620 is positioned proximate to first end 640 of first portion 610, then first end 660 may form the distal tip of first collar stay 130 (as shown in FIG. 8), and first collar stay 130 may have a maximum length.

Third portion 630 may be configured to be overlaid on second portion 620, and be coupled to first portion 610 and second portion 620 via second hinge 605. In embodiments, second hinge 605 may not be positioned equidistance from a first end 650 and second end 650 of third portion 610. As such, responsive to rotating third portion 630 about second hinge 605, a length of first collar stay 130 may change. For example, as shown in FIG. 6, when first end 650 is positioned at a distal tip of first collar stay 130, then first collar stay 130 may have a first length that is shorter than the maximum length of first collar stay as shown in FIG. 8. When second end 650 is positioned at a distal tip of first collar stay 130, as shown in FIG. 7, then first collar stay 130 may have a second length that is longer than the first length but shorter than the maximum length of first collar stay 130.

Utilizing the different lengths of first collar stay 130, collar stay device 100 may be configured to support collar pockets of a plurality of different articles of clothing and wearers.

Figure 9:
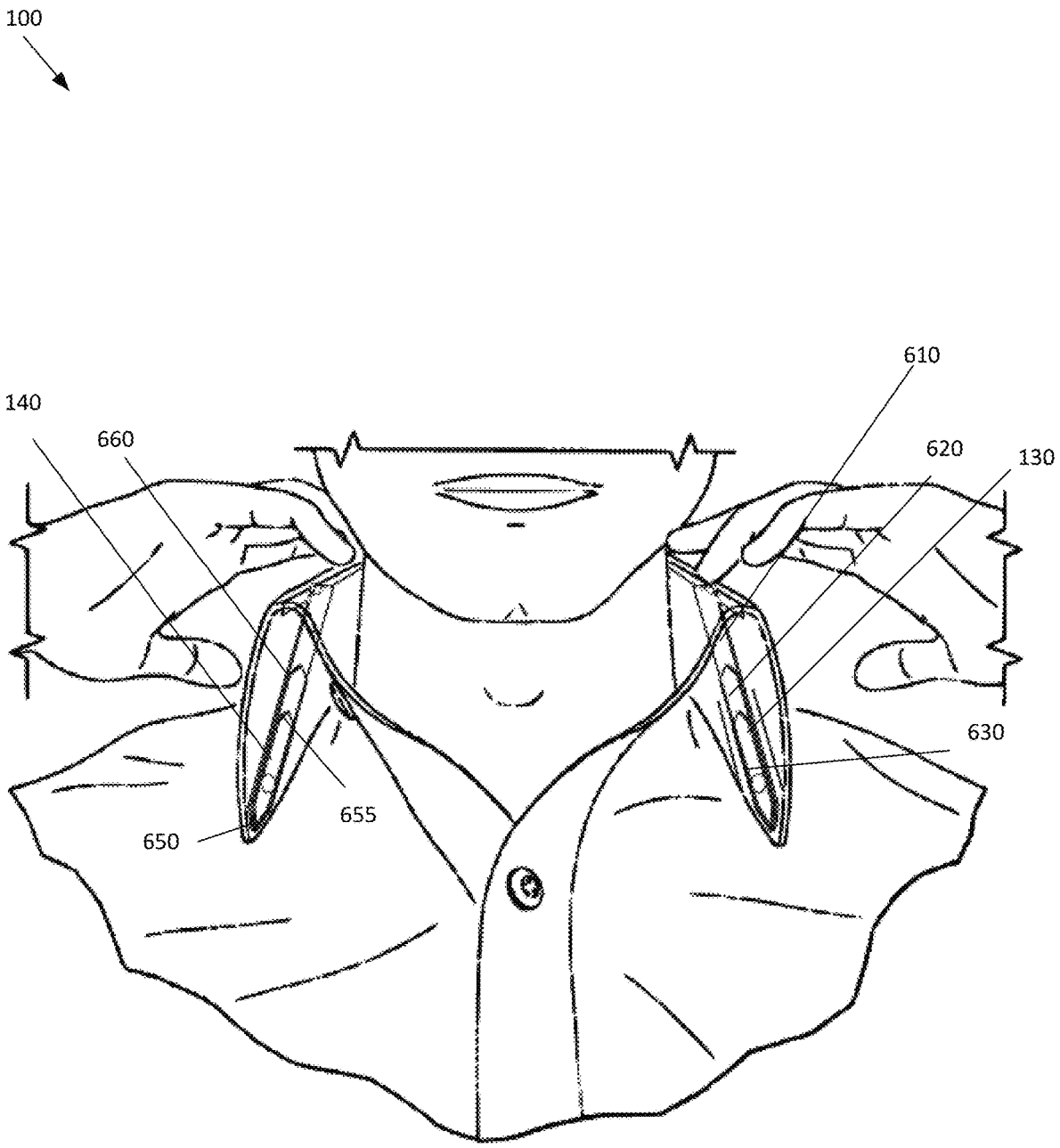
FIG. 9 depicts a collar stay device embedded within an article of clothing, according to an embodiment.

FIG. 9 depicts a collar stay device 100 embedded within an article of clothing 100, according to an embodiment. As depicted in FIG. 9, a first band and a second band of collar stay device 100 may be elongated such that the hinges of the collar stays are aligned with the stay pockets. Then, the angles of collar stays 130, 140 may be adjusted to align with the angle of the stay pockets, and the length of collar stays 130, 140 may be adjusted to align with the depth of the stay pockets. Subsequently, first collar stay 130 and second collar stay 140 may be inserted into the collar pockets, and the shirt collar may be flipped down.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

What is claimed is:

1. A collar stay device comprising:

a first band;

a second band, wherein the first band and the second band are configured to move along a linear axis to elongate or shorten;

a first collar stay positioned on the first band, the first collar stay being configured to rotate about a first joint, a second collar stay positioned on the second band, the second collar stay being configured to rotate about a second joint, the first joint and the second joint being positioned on the linear axis, wherein the first collar stay is configured to rotate independently from the rotation of the second collar stay and the movement of the first band and the second band along the linear axis, wherein the first collar stay includes a first portion, a second portion, and a third portion, the first portion being coupled to the first band via the first joint, the second portion and the third portion being coupled to the first portion via a third joint.

2. The collar stay device of claim 1, wherein the third joint is not positioned equidistance from a first end of the second portion and a second end of the second portion.

3. The collar stay device of claim 2, wherein the third joint is not positioned equidistance from a third end of the third portion and a fourth distal end of the third portion.

4. The collar stay device of claim 3, wherein the second portion is overlaid on the first portion, and the third portion is overlaid on the second portion.

5. The collar stay device of claim 4, wherein in a first mode a first length of the first collar stay is equal to a distance from the first joint to the third end.

6. The collar stay device of claim 5, wherein in a second mode a second length of the first collar stay is equal to the distance from the first joint to the fourth end, the second length being greater than the first length.

7. The collar stay device of claim 6, wherein in a third mode a maximum length of the first collar stay is equal to the distance from the first joint to the first end, the maximum length of the first collar stay being greater than the first length and the second length.

8. The collar stay device of claim 1, wherein the first collar stay is positioned between a first end of the first band and a second end of the first band.

9. A method utilizing a collar stay device comprising:

coupling a first band and a second band together;

moving the first band and the second band along a linear axis;

positioning a first collar stay on the first band, wherein the first collar stay includes a first portion, a second portion, and a third portion;

rotating the first collar stay about a first joint;

positioning a second collar stay on the second band;

rotating the second collar stay about a second joint; and coupling the first portion to the first band via the first joint; and coupling the second portion and the third portion to the first portion via a third joint, the first joint and the second joint being positioned on the linear axis, wherein the first collar stay is configured to rotate independently from the rotation of the second collar stay and the movement of the first band and the second band along the linear axis.

10. The method of claim 9, wherein the third joint is not positioned equidistance from a first end of the second portion and a second end of the second portion.

11. The method of claim 10, wherein the third joint is not positioned equidistance from a third end of the third portion and a fourth distal end of the third portion.

12. The method of claim 11, further comprising:

overlaying the second portion on the first portion; and overlaying the third portion is overlaid on the second portion.

13. The method of claim 12, further comprising:

rotating the third portion to be in a first mode, wherein in the first mode a first length of the first collar stay is equal to a distance from the first joint to the third end.

14. The method of claim 13, further comprising:

rotating the third portion to be in a second mode, in the second mode a second length of the first collar stay is equal to the distance from the first joint to the fourth end, the second length being greater than the first length.

15. The method of claim 14, further comprising:

rotating the second portion to be in a third mode, wherein in the third mode a maximum length of the first collar stay is equal to the distance from the first joint to the first end, the maximum length of the first collar stay being greater than the first length and the second length.

16. The method of claim 9, further comprising:

rotating the second portion is independently from the third portion, and rotating the first portion about the first joint independent from the second portion rotating about the third joint.

17. The method of claim 9, wherein the first collar stay is positioned between a first end of the first band and a second end of the first band.

18. The collar stay device of claim 9, wherein the second portion is configured to rotate independently from the third portion, and the first portion is configured to rotate about the first joint independent from the second portion rotating about the third joint.

* * * * *